United States Patent [19]

Koschinek et al.

[11] 4,374,797

[45] Feb. 22, 1983

[54] PROCESS FOR THE PRODUCTION OF HIGH STRENGTH YARNS BY SPIN-STRETCHING AND YARNS PRODUCED BY THE PROCESS, ESPECIALLY FROM POLYAMIDE-6 AND POLYESTER FILAMENTS

[75] Inventors: Günter Koschinek, Dietzenbach; Dietmar Wandel, Hanau, both of Fed. Rep. of Germany

[73] Assignee: Davy McKee Aktiengesellschaft, Fed. Rep. of Germany

[21] Appl. No.: 281,595

[22] Filed: Jul. 9, 1981

[30] Foreign Application Priority Data

Jul. 12, 1980 [DE] Fed. Rep. of Germany ..... 3026451

[51] Int. Cl.[3] ..... D01D 5/16

[52] U.S. Cl. ..... 264/210.3; 264/210.8; 264/342 RE

[58] Field of Search ..... 264/195 F, 342 RE, 210.3, 264/210.8

[56] References Cited

U.S. PATENT DOCUMENTS

| | | | |
|---|---|---|---|
| 3,715,421 | 2/1973 | Martin et al. | 264/210.8 |
| 4,003,974 | 1/1977 | Chantry et al. | 264/210.8 |
| 4,070,432 | 1/1978 | Tamaddon | 264/210.3 |
| 4,228,120 | 10/1980 | Bromley et al. | 264/176 F |
| 4,229,500 | 10/1980 | Adachi et al. | 264/210.8 |
| 4,237,187 | 12/1980 | Raybon et al. | 264/176 F |
| 4,251,481 | 2/1981 | Hamlyn | 264/210.3 |

FOREIGN PATENT DOCUMENTS

| | | | |
|---|---|---|---|
| 50-25819 | 3/1975 | Japan | 264/210.8 |

*Primary Examiner*—Jay H. Woo

*Attorney, Agent, or Firm*—Allegretti, Newitt, Witcoff & McAndrews, Ltd.

[57] ABSTRACT

An improved process for the spin-drawing of high-tenacity, technical-grade yarns is disclosed. The process produces yarns of high industrial quality having a low break elongation and low reference elongation, or a low heat shrinkage and low reference elongation. The process is especially suitable for yarns of polyamide and polyester.

12 Claims, 3 Drawing Figures

PROCESS FOR THE PRODUCTION OF HIGH STRENGTH YARNS BY SPIN-STRETCHING AND YARNS PRODUCED BY THE PROCESS, ESPECIALLY FROM POLYAMIDE-6 AND POLYESTER FILAMENTS

BACKGROUND OF THE INVENTION

The invention relates to a process for the production of high-tenacity technical-grade yarns, particularly of polyamide and polyester, having a low reference elongation, by spin-drawing, in which the filaments extruded from a spinneret are cooled in a cooling zone by being exposed to a stream of air, are passed over a preparation device, and then passed directly over several sets of rolls to be drawn, in at least one draw field, between at least two of the sets of rolls. The filaments are subjected to a temperature of at least 160° C. in at least one set of rolls and, finally, are passed over a set of let down rolls prior to being wound up at a speed of at least 2,200 meters/min.

In order to use the yarns for straps, belts and layer webs for textile fabrics, the heat shrinkage of the yarns should be low and, at the same time, the lowest possible reference elongation should be sought.

Feed yarns made from polyamide or polyester will undergo a change in textural condition during the various process stages. In the article, "Spinning Process and Crystal Structure of Perlon," Angewandte Chemie, Vol. 74, 1962, No. 13, p. 566, it is noted that a yarn drawn directly during the spinning operation passes through crystallization stages that are different from those of a yarn made on a drawing machine from staple stock.

Furthermore, at higher production speeds, a uniform temperature transfer to the yarn becomes more difficult. Higher speeds also translate into shorter contact times between the yarn and the heating systems, so that the heating of the yarn to predetermined temperatures becomes more of a problem. However, it is the temperature and structural properties which largely determine the attainable qualitites of textile yarn.

The technical and economical value of the spin-draw process, however, can be rated as positive only if, at the same time, the textile yarn qualities are not impaired and even improved.

From German published patent application No. 1,435,467, a process for spin-drawing of polyester (PES) at speeds of 1000 to 4000 m/min. is known. The process disclosed therein utilizes a temperature treatment of the filaments at predetermined residence times prior to the drawing operation. However, no process parameters for drawing and thermal stabilizing, such as temperature control and yarn tensions, are disclosed. In applying the teachings of this reference, low reference elongation values were generally obtained in combination with high tenacities and low elongation or low shrinkage values.

U.S. Pat. No. 3,452,131 and German published patent application No. 1,912,299 disclose processes for the spin-drawing of polyamide filaments in which additional draw means are employed. In the case of a steam jet, there is a danger of simultaneous wetting or moistening because of the low yarn temperature, a fact which is well known, and which has a substantial influence on the glass transition point. At high speeds, i.e., short residence times, this expedient may lead to complications in the drawing process. The use of a stationary draw pin is known from conventional methods, but is recommended only for moderate speeds. At high speed production, the friction is too strong causing the increase in temperature of the pin to be uncontrollable. Both of these references fail to make any recommendations as to how low reference elongations might be attained.

If, in spin-drawing, the cooled filaments are drawn at high speeds on stationary draw means, and if, for the purpose of increasing productivity, more than one strand of filaments is processed at one station, there is danger of non-uniform draw action, particularly among the yarns at different stations.

U.S. Pat. No. 3,790,995 discloses a process for spin-drawing of polyester at speeds of at least 1800 m/min, in which the feed and draw rolls are provided with a surface roughness to allow slippage of the continuous filaments over a number of wraps on the rolls. Such filament slipping leads to a high degree of friction at high production speeds, and the frictional heat generated causes an uncontrollable increase in temperature of the rolls. No teaching can be derived from the given parameters of this reference as to how to achieve a low reference elongation.

U.S. Pat. No. 4,003,974 discloses a process for spin-drawing of polyester, in which the filaments are thermally stabilized or "set" at 225°-250° C., and are allowed to relax at a tension of 0.09-0.15 g/den, with a speed given, by way of example, as 1.829 m/min. It does not teach an operation at higher speeds. The given temperatures could not be further increased because temperatures in the range of the polymer melting point cause the filaments to stick to the rolls. An increase in the residence time of the filaments on heated rolls has limits for mechanical reasons. Relaxation tensions of the given range generally cause a shrinkage of the filament to an extent which necessarily is offset by a high and undesired reference elongation. As relaxation tensions of less than or equal to 0.2 g/dtex are applied to the heated, thermally set filaments, either between the heated draw rolls, or between the heated relaxation roll and the windup unit operating at different speeds, a severe yarn shrinkage occurs which, while yielding a lower heat shrinkage value, also results in a high reference elongation value. In the process disclosed, the heated, thermally fixed yarn is passed over the unheated relaxation or let down roll onto the windup or, if the last named roll was used for the thermal setting operation, directly onto the windup. The yarn is not allowed to cool off sufficiently fast and, therefore, has a tendency to shrink while under low tension. The result is an increase in the reference elongation. This becomes more critical with higher production speeds, and, thus, lower residence times of the yarn.

SUMMARY OF THE INVENTION

The object of the present invention is to provide a process for spin-drawing of high tenacity, technical-grade yarns which, notwithstanding high production speeds, produces yarns of high industrial quality having a low break elongation and low reference elongation, or a low heat shrinkage and low reference elongation.

The object of the present invention is achieved through the following steps:

(a) The set of rolls positioned in advance of the minimum of one draw zone is heated to a constant temperature between $T_G-20°$ C. and $T_G+65°$ C., with $T_G$ being the temperature of the glass transition point, and the filaments are drawn without the use of additional stationary draw means;

(b) The sets of rolls following the minimum of one draw zone have a temperature in excess of 110° C., and the tension of the yarn after leaving these roll systems is not less than 0.2 g/dtex;

(c) The residence time of the yarn in the let down roll system is selected to be at least 0.2 sec.;

(d) The windup speed of the yarn does not decrease by more than 2.5% from the peripheral speed of the let down roll system; and (e) The temperature of the system of let down rolls is adjusted to a value of less than or equal to 110° C.

The yarn packages thus produced can be used directly on a thread machine without requiring any additional process steps. Plying and twisting of the yarn will produce cord for further processing in textile manufacture.

By combining the two operational steps of spinning and drawing, the coupled spin-drawing process saves a separate operation, and, by employing high windup speeds, it becomes extremely economical.

The drawn feed yarns meet high quality requirements because of their predictable technical performance in the manufacture of woven and other textiles.

Feed yarn used in the manufacture of tire cord requires, in addition to other properties, first and foremost, a high degree of tenacity, low break elongation and low reference elongation. These conditions are also met by the product of the present invention.

The characteristic features of the invention define for each process step a specific treatment of the yarn, as determined by yarn temperatures, yarn residence times and yarn tensions, so that a combination of the inventive features will yield the desired yarn characteristics. The heating of the filament yarn on the rotating rolls is sufficient to permit a precise adjustment of the temperature necessary for the drawing operation and the thermal treatment. The upper limit of temperatures of greater than or equal to 160° C. employed in the thermal setting step of the yarn is defined by the instant the yarn adheres to the rolls, i.e., when the temperature range of the polymer melting point has been reached. Hence, the maximum possible temperature is higher for polyester than it is for polyamide-6. In conventional processes, the yarn then may pass into a low tension zone of less than or equal to 0.2 g/dtex thereby causing a considerable shrinkage of the yarn, depending on the yarn temperature. Such relaxation of the yarn is in part desired because the tendency of the finished yarn to shrink in hot air is thereby lessened, i.e., a yarn is obtained having a low dry heat shrinkage value. In conventional processes, relaxation tensions of less than or equal to 0.15 g/den are employed to obtain dry heat shrinkage values (at 160° C.) of less than or equal to 4%. This, however, is accompanied by a strong increase in reference elongation, which is undesirable for technical-grade material. Consequently, it is necessary to limit the relaxation tension to greater than or equal to 0.2 g/dtex to obtain a low reference elongation, along with low dry heat shrinkage.

To eliminate relaxation to a large extent, tensions of greater than or equal to 1.0 g/dtex are employed, so that yarns having a low break elongation and low reference elongation are obtained. If the let-down roll is heated for the thermal stabilization step of the yarn, the heated yarn, upon leaving the let-down roll, directly enters a region of low tension, which is usually adjusted at less than 0.2 g/dtex prior to the windup operation and a stable build-up of the yarn package. However, since the yarn temperature is much higher than 110° C., the reference elongation will be strongly increased, as in Example 6 herein.

Even if the let-down roll is not heated, the yarn heated on the roll effecting the thermal stabilization transfers considerable quantities of heat to the let down roll. At medium speeds of less than 2,200 m/min and thermal setting temperatures of 190°–250° C., conventional let down rolls will heat up to temperatures of 55°–85° C. Increasing the speed may cause the roll temperature to rise up to 115° C. The yarn leaving the roll then has a relatively high temperature and experiences a strong and undesirable shrinkage. If, however, the let rolls are cooled, the yarn temperature will decrease accordingly and the tendency of the yarn to shrink is curtailed to a large extent.

While the heating of the yarn by contact with rolls at high production speeds if difficult, the cooling carried out under the conditions according to the present invention has produced a positive effect. The preferred let down roll system consists of at least one driven roll and may include additional rolls, not driven and freely mounted, and a stretch or zone of free space between the rotating aggregates. The flow of air, especially in the zone of free space, produces a special cooling effect if the total residence time is at least 0.2 sec.

The speed ratio between the let-down roll and the windup device directly determines the shrinkage of the yarn and, in combination with the associated yarn tension, also the shrinkage tendency of the yarn on the bobbin. For these reasons, the speed ratio must not exceed the specified limit. Under conventional conditions, the ratio is in excess of 2.5% with a usual windup tension of less than 0.2 g/dtex. However, only with yarn cooled as proposed by the present invention can low ratios be realized. Such yarns then have a lower shrinkage propensity and, hence, a lower value of the reference elongation.

The process of the invention may be carried further to best advantage through the following steps:

(1) the filaments extruded from the spinneret are passed through a heat zone before they enter the cooling zone;

(2) for the preparation of the filaments, an oil having less than 5% by weight of water, particularly a water-deficient oil, is applied to the filaments in the absence of heat;

(3) the let down roll system is unheated and is provided with cooling means enabling a surface temperature of less than or equal to 25° C.;

(4) in the proximity of the set of let down rolls, a cooling zone is provided having a temperature of less than or equal to 25° C. to enable a heat exchange with the yarn;

(5) the residence time of the yarn in the cooling zone is adjusted to be at least 0.4 sec;

(6) the set of let-down rolls is positioned in a closed environment, the temperature of which is maintained by forced cooling at or below 45° C.;

(7) the tension of the withdrawn yarn is not less than 0.5 g/dtex;

(8) the set of rolls positioned downstream of the drawing zone has a temperature of at least 160° C. and the yarn tension of the withdrawn yarn is not less than 1.0 g/dtex; and (9) the yarn is passed through a whirling unit prior to being wound up in order to improve the closing off of the yarn end.

The process of the present invention will be described in further detail with reference to a preferred embodiment illustrated in FIGS. 1–3 and several process examples. The characteristics of all examples are summarized in the table at the end of the description.

DETAILED DESCRIPTION OF THE PREFERRED EMBODIMENTS

Figure 1:
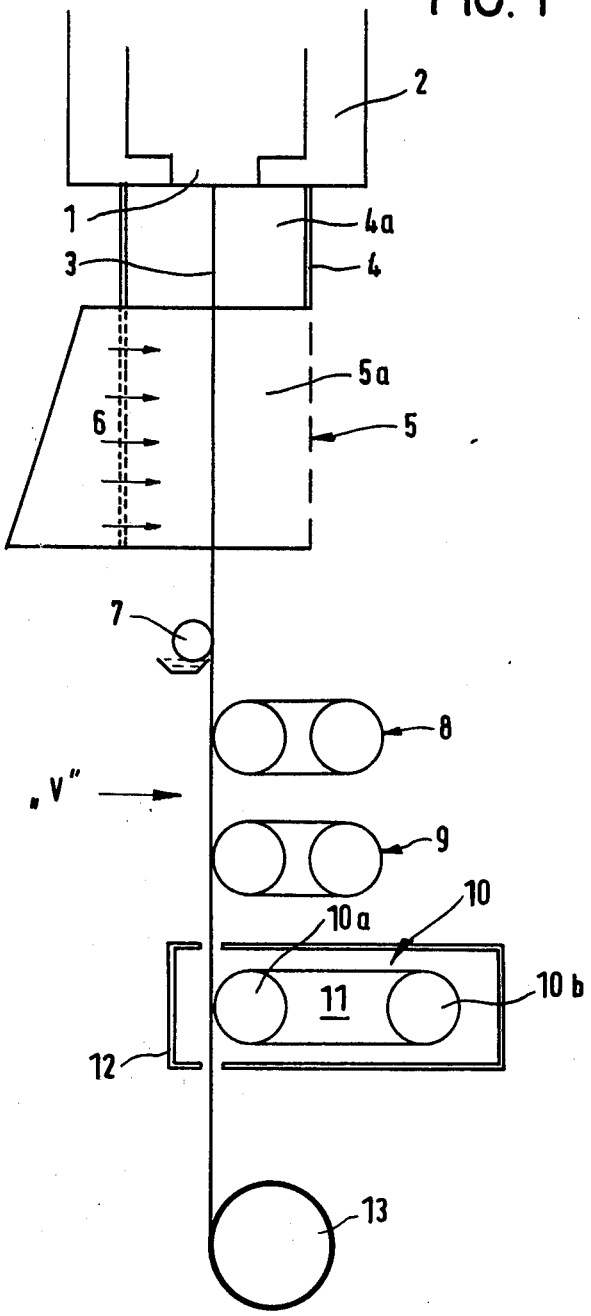
FIG. 1 is a diagrammatic illustration of an apparatus for use with a preferred embodiment of the process according to the present invention.

Referring to FIG. 1, a spinneret 1 has a multiplicity of orifices or holes in a spinning block 2. Filaments 3, which subsequently form continuous filament strands or yarn are extruded from the spinneret 1 and are passed through a heater 4 enclosing a heating zone 4*a*. The filaments 3 then pass through a blow duct 5, enclosing a cooling zone 5*a*, in which the filaments are cooled by an air current blowing in the direction of the arrows 6.

Below the blow duct 5, a preparation system 7 is arranged by which a finish or preparation is applied to the filaments. Following is a first set of rolls 8 ("first duo"), which may be designated a feed roll system and which is heated to a temperature of $T_G-20°$ C. to $T_G+65°$ C., based on the glass transition point. The continuous filaments 3 are passed over this roll system 8.

The first roll system 8 is followed by a second roll system 9 ("second duo"), which may be termed a draw roll system, and over which the filaments 3 also are passed. Located between the two roll systems 8 and 9 is a draw zone "V." The roll system 9 consists of rolls which have a temperature of more than 110° C. and the strands of filaments 3 leaving this roll system have a yarn tension of at least 0.2 g/dtex. In the case where only a single roll system 9 is provided, subsequent to the draw zone, as shown in FIG. 1, this roll system is additionally and simultaneously adapted to fulfill the condition that the respective rolls have a temperature of at least 160° C.

Following the roll system 9 is a let-down roll system 10 ("third duo") which, like the roll systems 8 and 9, is in the form of a "duo," i.e., it consists of two rolls 10*a* and 10*b*. In the region of the roll system 10, a cooling zone 11 is formed which is located inside a roll box or casing 12 enclosing the rolls 10*a* and 10*b*. The arrangement of the rolls 10*a* and 10*b* is such that the residence time of the strands of filaments 3 in the let-down roll system 10 and the cooling zone 11, respectively, is at least 0.2 sec. The temperature of the let-down roll system 10 is no greater than 110° C.

Finally, a windup unit 13 is provided for the takeup of the yarn 3. The peripheral speed of the windup 13, at the point of first contact with the yarn, decreases by no more than 2.5% from the peripheral speed of the let-down roll system 10.

The present invention can be better understood with reference to the following examples. Characteristic values used in the following examples are based on the following measuring procedures: Tenacity and break elongation were measured on conventional tensile testing equipment. The reference elongation was determined from the load/extension diagram of the yarn. The reference elongation is defined as the elongation of the yarn at a force of 4.85 g/dtex.

EXAMPLE 1

Polyamide-6 having a relative viscosity $n_{rel}$ of 3.3 was melted at 293° C. and was passed at a rate of 247 g/min through two spinneret plates each having 140 holes, each hole having a diameter of 0.4 mm.

The extruded filaments were passed through a 600 mm long heater having a wall temperature of 300° C., and were subsequently passed through a 1100 mm long blow duct in which they were cooled by a transversely directed air current blowing at a speed of 0.8 m/sec.

Thereafter, a 99% preparation was applied to the filaments by means of cold rolls, so that the oil film on the finished feed yarn was 1.1%.

The continuous filaments were then drawn between two sets of rolls (duos) at a temperature of 90° C. and a draw ratio of 1:5.1, were thermally stabilized on the second duo at a temperature of 195° C., were passed over the unheated let-down roll system at a temperature of 45° C. and a speed of 2,805 m/min, and then through a cooling zone having an ambient temperature of 40° C., and were finally wound up at a speed of 2,740 m/min.

Disregarding the permissible amount of shrinkage between duo 2 and duo 3, the thermal setting tension was 2.1 g/dtex, the windup tension was 150 g, and the denier of the wound up yarn was 940/140 dtex. The residence time of the yarn in the let-down or relaxation roll system was 0.72 sec.

No disturbances occurred in the drawing operation. The yarn characteristics are reported in Table 1. A high tenacity was obtained as well as a low break elongation and a low reference elongation.

EXAMPLE 2

Polyamide-6 filaments were extruded and spin-drawn under the same conditions as in Example 1, except that the temperature of the let-down roll system was adjusted to 60° C. and the cooling zone temperature was 32° C. The values reported in Table 1 show a further improvement in the reference elongation. The tenacity was somewhat lower and the break elongation was slightly higher than in Example 1.

EXAMPLE 3

Polyamide-6 filaments were extruded and spin-drawn under the same conditions as in Example 2, except that two pairs of rolls operating at the same speed were used as the let-down roll system. The pair of rolls, first engaged by the filaments, had a temperature of 60° C., the second pair of rolls had a temperature of 34° C., and the cooling zone had a temperature of 23° C. The residence time of the yarn in this system was 2.7 sec. There were no difficulties during the drawing operation. The yarn showed a low break elongation and a low reference elongation coupled with a high tenacity.

EXAMPLE 4

(Comparison Example)

Polyamide-6 filaments were extruded and prepared under the same conditions as in Example 1. The filaments were drawn between two sets of rolls (duos) at a temperature of 90° C. and a draw ratio of 1:5.1. They were allowed to thermally set on the second duo at a temperature of 195° C., were passed over unheated let down rolls operating at a speed of 2,805 m/min, and finally were wound up at a speed of 2,675 m/min.

The temperature of the let-down rolls adjusted itself after a short initial period of a few seconds to a surface temperature of 112° C. The residence time of the yarn on these rolls was 0.15 sec. Disregarding the permissible amount of shrinkage occurring between duo 2 and duo 3, the setting tension was 2.1 g/dtex. The windup tension was 150 g. The finished yarn thus produced exhibited a strong shrinkage propensity during the windup which had an adverse effect on the buildup of the yarn package. The yarn showed a low tenacity and a higher break elongation than in Example 1. The reference elongation was substantially higher than in the previous examples.

EXAMPLE 5

Polyamide-6 having a relative viscosity $n_{rel}$ of 2.8 was melted at 284° C. and was extruded at a rate of 247 g/min through a spinneret plate with 140 holes, each hole having a diameter of 0.4 mm. The extruded filaments were passed through a 1700 mm long blow duct in which they were cooled by a transversely directed current of air blowing at a speed of 0.6 m/sec. Thereafter, a 99% preparation was applied to the filaments by cold rolls, so that the oil film on the finished yarn was 0.8%.

The filaments were then drawn between two sets of rolls (duos) at a temperature of 90° C. and a draw ratio of 1:5.1. On the second duo, the continuous filament strands were allowed to thermally set, were passed over the unheated let-down roll system operating at a speed of 2,805 m/min, and were finally wound up at a speed of 2,790 m/min. The let-down rolls were water cooled and maintained at a temperature of 23° C. The cooling zone had an ambient temperature of 20° C. The residence time in the let-down roll system was 1.6 sec. At a relaxation tension of 0.22 g/dtex between duo 2 and duo 3 and a windup tension of 150 g, a denier of 940/140 dtex was obtained.

The yarn thus produced had a dry heat shrinkage of 3.5% and a reference elongation of 8.5%. The break elongation was about 19.8%.

EXAMPLE 6

(Comparison Example)

Polyamide-6 filaments were extruded and spin-drawn under the same conditions as in Example 5, except that the let-down roll was adjusted to a temperature of 195° C., the yarn residence time was 0.15 sec., and the windup speed was 2,635 m/min.

While the yarn thus obtained showed a dry heat shrinkage of 3.7%, which is comparable to the result of Example 5, it had a substantially higher reference elongation of 12%. The break elongation of 24% was clearly higher.

EXAMPLE 7

Polyester having a relative viscosity $n_{intr}$ of 0.68 was melted at 305° C. and was extruded at a rate of 307 g/min from two spinneret plates, each having 192 holes, each hole having a diameter of 0.4 mm. The extruded filaments were passed through a 1700 mm long blow duct in which they were cooled by a transversely directed stream of air flowing at a speed of 0.6 m/sec. Thereafter, a 99% preparation was applied to the filaments by cold rolls, so that the oil film of the finished yarn was 0.7%.

The filaments were then drawn between two sets of rolls (duos) at a temperature of 115° C. and a draw ratio of 1:6.1. On the second duo, the filaments were allowed to thermally set at a temperature of 220° C., were then passed over the unheated let-down roll system at a temperature of 45° C. and a speed of 3,050 m/min, and through the cooling zone at a temperature of 38° C., and were finally wound up at a speed of 2,990 m/min.

With a permissible amount of shrinkage between duo 2 and the let-down roll system, with a relaxation tension of 0.2 g/dtex and a windup tension of 170 g, a yarn of 1100/192 dtex denier was obtained. The residence time of the yarn in the let-down roll system was 0.22 sec. No disturbances occurred during the drawing operation. The dry heat shrinkage was 3.5%, the reference elongation was 7.6%, and the break elongation was about 13.5%.

In a subsequent run, the permissible amount of shrinkage between duo 2 and the let-down roll system was varied, all other conditions remaining equal. The setting tension increased to 1.2 g/dtex.

Figure 2:
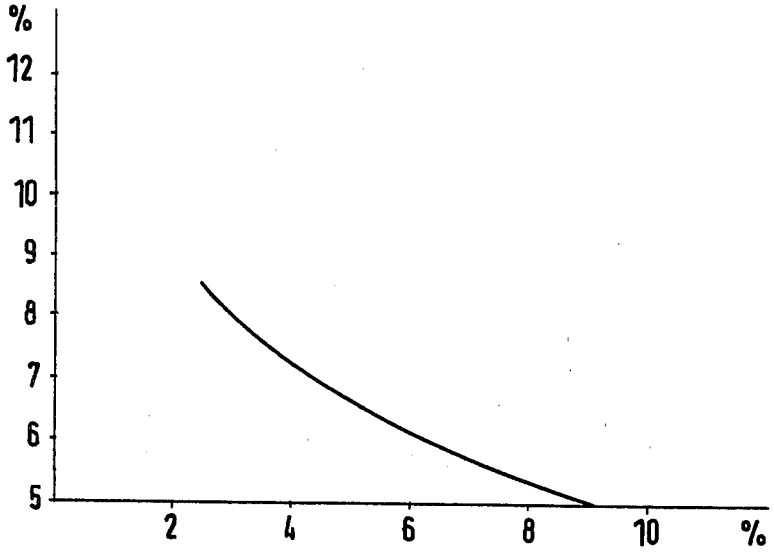
FIG. 2 is a graph showing the relation between reference elongation (ordinate) and heat shrinkage (abscissa).
Figure 3:
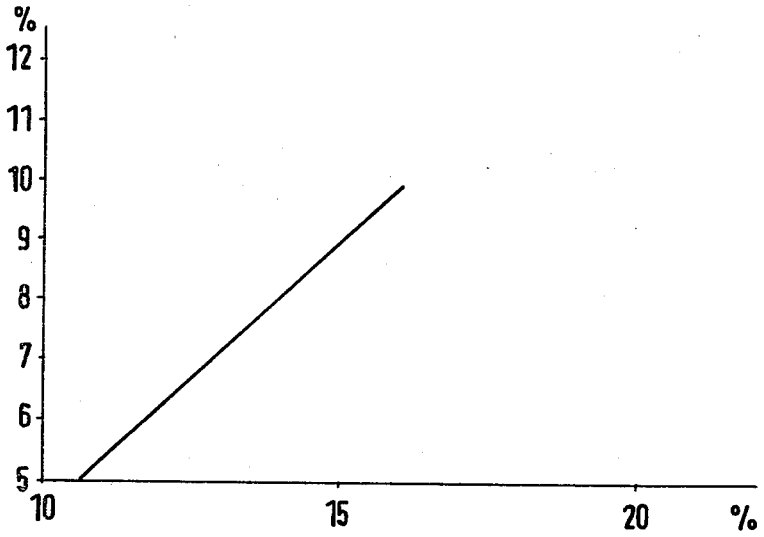
FIG. 3 is a graph showing the relation between reference elongation (ordinate) and break elongation (abscissa).

By this modification of the process, it is possible to obtain yarns having the desired reference elongation, up to about 5%, and a low break elongation, as is shown in FIG. 2, in which the abscissa represents the dry heat shrinkage and the ordinate represents the reference elongation, each in percentage. It will be noted, however, that, with low reference elongations, the dry heat shrinkage increases. In FIG. 3, the abscissa shows the break elongation and the ordinate shows the reference elongation, each in percentage. The graphs illustrate Example 7, i.e., they are representative of polyester.

EXAMPLE 8

(Comparison Example)

Polyester filaments were extruded and spin-drawn under the same conditions as in Example 7, except that the unheated let-down roll system, after an initial period of a few seconds, heated itself up to a temperature of 115° C.

With about the same dry heat shrinkage value as in Example 7, a substantially higher reference elongation of 9.9% was obtained. The tenacity value was clearly lower.

TABLE 1

| Example No. | 1 | 2 | 3 | 4 | 5 | 6 | 7 | 8 |
|---|---|---|---|---|---|---|---|---|
| Invention/Comparison | Invention | Invention | Invention | Comparison | Invention | Comparison | Invention | Comparison |
| Polymer | PA-6 | PA-6 | PA-6 | PA-6 | PA-6 | PA-6 | PES | PES |
| Denier (dtex) | 940/140 | — | — | — | 940/140 | — | 1100/192 | — |
| Speed (m/min) | | | | | | | | |

TABLE 1-continued

| Example No. Invention/Comparison | 1 Invention | 2 Invention | 3 Invention | 4 Comparison | 5 Invention | 6 Comparison | 7 Invention | 8 Comparison |
|---|---|---|---|---|---|---|---|---|
| 1st down rolls 10 | 2,805 | 2,805 | 2,805 | 2,805 | 2,805 | 2,805 | 3,050 | 3,050 |
| windup unit 13 | 2,740 | 2,740 | 2,740 | 2,675 | 2,790 | 2,635 | 2,990 | 2,925 |
| Draw ratio 1: | 5.1 | 5.1 | 5.1 | 5.1 | 5.1 | 5.1 | 6.1 | 6.1 |
| Admissible shrinkage % | 0 | 0 | 0 | 0 | 6 | 6 | 5 | 5 |
| Temp. roll system 8 °C. | 90 | 90 | 90 | 90 | 90 | 90 | 115 | 115 |
| roll system 9 °C. | 195 | 195 | 195 | 195 | 195 | 195 | 220 | 220 |
| let-down roll 10 °C. | 45 | 60 | 60/34 | 112 | 23 | 195 | 45 | 115 |
| roll box °C. | 40 | 32 | 23 | 23 | 20 | 20 | 38 | 38 |
| Setting tension g/dtex | 2.1 | 2.1 | 2.1 | 2.1 | 0.22 | 0.22 | 0.2 | 0.2 |
| Windup tension g | 150 | 150 | 150 | 150 | 150 | 150 | 170 | 170 |
| Residence time of the yarn in the let down system sec. | 0.72 | 0.72 | 2.7 | 0.15 | 1.6 | 0.15 | 0.22 | 0.22 |
| Yarn characteristics: | | | | | | | | |
| reference elongation % | 8.3 | 8.0 | 7.0 | 10.0 | 8.5 | 12 | 7.6 | 9.9 |
| break elongation % | 18.4 | 19.0 | 17.8 | 22 | 19.8 | 24 | 13.5 | 16 |
| tenacity g/dtex | 9.0 | 8.5 | 9.1 | 8.3 | 7.8 | 7.2 | 7.7 | 6.9 |
| Dry heat shrinkage % | 7.9 | 7.8 | 8.2 | 8.0 | 3.5 | 3.7 | 3.5 | 3.6 |

We claim as our invention:

1. An improved process for the production of high-tenacity technical-grade yarns of polyamide and polyester, having a low reference elongation, by spin-drawing in which filaments extruded from a spinneret are cooled in a cooling zone by being exposed to a stream of air, said filaments being passed over a preparation device and then passed directly over a plurality of sets of rolls, said plurality of sets of rolls forming roll systems, said filaments being drawn between at least two sets of rolls in at least one draw field, said filaments being subjected to a temperature of greater than or equal to 160° C. on at least one set of rolls and subsequently being passed over a set of let-down rolls, constituting a let-down roll system, immediately prior to being wound up at a windup speed of greater than or equal to 2,200 m/min., the improvement comprising:

(a) heating a set of rolls, said set of rolls being positioned in advance of a minimum of one draw zone, said set of rolls being heated to a constant temperature, said temperature being in a range of ($T_G-20°$ C.) to ($T_G+65°$ C.), wherein $T_G$ is the temperature of the glass transition point, said filaments being drawn over said set of rolls without the use of additional stationary draw means;

(b) maintaining a set of rolls at a temperature in excess of 110° C., said set of rolls being positioned following a minimum of one draw zone, said yarn having a tension of not less than 0.2 g/dtex upon leaving said roll system;

(c) permitting said yarn to remain in said let-down roll system for a residence time, said residence time being selected to be at least 0.2 sec.;

(d) maintaining said windup speed of said yarn at a speed not less than 2.5% less than the peripheral speed of said let-down roll system; and, (e) adjusting the temperature of said let-down roll system to a temperature of less than or equal to 60° C.

2. The process of claim 1, wherein said filaments extruded from said spinneret are passed through a heated zone prior to entering said cooling zone.

3. The process of claim 1, wherein said filaments are prepared in said preparation device with an oil having less than 5% by weight of water, said oil being a water-deficient oil, said oil being applied to said filaments in the absence of heat.

4. The process of claim 1, wherein said let-down roll system is unheated and provided with cooling means, said cooling means providing a surface temperature of less than or equal to 25° C.

5. The process of claim 1, wherein said let-down rolls are disposed in a cooling zone, said cooling zone having a temperature of less than or equal to 25° C. thereby enabling a heat exchange with said yarn.

6. The process of claim 5, wherein said yarn having a residence time in said cooling zone, said residence time being adjusted to be at least 0.4 sec.

7. The process of claim 1, wherein said set of let-down rolls being positioned in a closed environment, said closed environment having a temperature, said temperature being maintained by forced cooling at or below 45° C.

8. The process of claim 1, wherein said yarn being withdrawn, said yarn having a tension of not less than 0.5 g/dtex.

9. The process of claim 1, wherein said set of rolls being positioned following a minimum of one draw zone, said set of rolls having a temperature of at least 160° C., said yarn leaving said set of rolls having a yarn tension of not less than 1.0 g/dtex.

10. The process of claim 1, wherein said yarn being of polyamide, said polyamide being polyamide-6, said yarn being characterized by a break elongation of less than or equal to 19% and a reference elongation of less than or equal to 8.5%.

11. The process of claim 1, wherein said yarn being of polyamide, said polyamide being polyamide-6, said yarn being characterized by a heat shrinkage of less than or equal to 4% and a reference elongation of less than or equal to 8.5%.

12. The process of claim 1, wherein said yarn being of polyester, said yarn being characterized by a heat shrinkage of less than or equal to 4% and a reference elongation of less than or equal to 9%.

* * * * *